US006199478B1

(12) United States Patent
Yoshida

(10) Patent No.: US 6,199,478 B1
(45) **Date of Patent: *Mar. 13, 2001**

(54) PRESS MACHINE

(75) Inventor: Akihiro Yoshida, Gifu-ken (JP)

(73) Assignee: Kabushiki Kaisha Yamada Dobby (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/326,772

(22) Filed: Jun. 4, 1999

(30) Foreign Application Priority Data

Apr. 8, 1999 (JP) ..... 11-101080

(51) Int. Cl.[7] ..... B30B 1/06; B30B 1/02

(52) U.S. Cl. ..... 100/282; 100/283; 100/285; 72/451

(58) Field of Search ..... 100/282, 283, 100/285; 72/450, 451; 83/626

(56) References Cited

U.S. PATENT DOCUMENTS 2,562,044 * 7/1951 Klocke ..... 100/283
3,791,191 * 2/1974 Baldyga ..... 72/451
6,012,322 * 1/2000 Itakura ..... 100/285

FOREIGN PATENT DOCUMENTS

1153251 * 2/1963 (DE) ..... 100/282
09225686 9/1997 (JP) .

* cited by examiner

*Primary Examiner*—Peter Vo
*Assistant Examiner*—Louis Huynh
(74) *Attorney, Agent, or Firm*—Ipsolon LLp

(57) ABSTRACT

A press machine comprises a frame, a first crankshaft rotatively arranged on the frame, a second crankshaft arranged on the frame so as to rotate angularly, a pair of levers connected with each other such that they can make a bending and stretching motion, one lever being connected with the frame such that it can make a pivotal motion but can not be relatively displaced, the other lever being pivotally connected with the second crankshaft, and a link which connects the levers with the first crankshaft and bends and stretches both of the levers as the first crankshaft is rotated, thereby enabling to reduce the number of parts constituting a transmission mechanism for transmitting the rotary motion of the first crankshaft to a slide.

5 Claims, 2 Drawing Sheets

PRESS MACHINE

BACKGROUND OF THE INVENTION

1. Field of the Invention

The present invention relates to a press machine of the class in which the first and second crankshafts are connected with each other by means of a link and a pair of levers 2. Prior Art In general, the press machine utilizing a link mechanism like a knuckle joint, a toggle joint and so forth, may be classified into two types, of which one is provided with a crankshaft rotated by a power or driving source while the other includes a driving crankshaft rotated by a driving source, and a driven or coupled crankshaft which makes the rocking motion or swing motion by rotation of the driving crankshaft. The press machine provided with two crankshafts has advantageous features than the press machine with a single crankshaft as described in the following.

In case of the press machine with two crankshafts, the upper portion of a slide can be connected with a plurality of rods (for instance, three or more rods), which can be driven by using a pair of link levers and the coupled crankshaft. The moment of inertia of the crankshaft itself is relatively small so that the time necessary for starting and stopping the operation of the press machine is made shorter, which allows the press machine to show the excellent performance and to operate at high speed. In addition, the number of parts constituting the press machine can be reduced, which again allows the press machine to operate at high speed.

An example of the press machine using a link mechanism is disclosed un the Japanese patent public diclosuer (KOKAI) No. 9-225686. This prior press machine is provided with a crankshaft rotated by a driving source and a bell crank mechanism connected with the eccentric shaft portion of the crankshaft, thereby enabling the slide to move in the up and down directions.

However, as described above, since this prior art press machine employs the bell crank mechanism as a transmission mechanism for converting the rotary motion of the crankshaft into the power for use in moving the slide in the up and down directions, the number of parts constituting the transmission mechanism is naturally increased. Increase in the number of parts constituting the transmission mechanism not only makes the structure of the transmission mechanism complicated, but also makes the force of inertia larger. Therefore, this is not suitable for operation of the press machine at high speed.

Thus, in the press machine of this class, it is of importance to reduce the number of parts constituting the transmission mechanism for transmitting the rotary motion of the crankshaft rotated by the driving source to the slider.

SUMMARY OF THE INVENTION

According to the invention, there is provided a press machine which includes a frame, a first crankshaft rotatively arranged on the frame, a second crankshaft arranged on the frame so as to rotate angularly, a pair of levers connected with each other such that they can make a bending and stretching motion, one lever being connected with the frame such that it can make a pivotal motion but can not be relatively displaced, the other lever being pivotally connected with the eccentric shaft portion of the second crankshaft, and a link which connects the levers with the first crankshaft and bends and stretches both of the levers as the first crankshaft is rotated.

Both levers are bent and stretched by the link as the first crankshaft is rotated, thereby causing the second crankshaft to make a rocking motion. The rocking motion of the second crankshaft is transmitted to the slide, thereby the slide coming to reciprocate in the up and down directions.

As described above, as the press machine of the invention is provided with the second crankshaft, the rotary motion of the first crankshaft is converted into the rocking motion of the second crankshaft with the help of the link and both of levers and is then transmitted to the slider. With this, there can be a remarkable reduction in the number of parts constituting the transmission mechanism for transmitting the rotary motion of the first crankshaft rotated by the driving source to the slide.

In a preferable embodiment according to the invention, the second crankshaft includes a principal shaft portion arranged on the frame so as to make a rocking motion, a first eccentric shaft portion pivotally connected with the above other lever, and a second eccentric shaft portion connected with a slide.

A press machine according to the invention may further include a connection piece connected with the eccentric shaft portion of the second crankshaft and moves the slide in the up and down directions as the second crankshaft makes the rocking motion. Furthermore, a press machine according to the invention may include rods arranged on the frame so as to move in the up and down directions and are pivotally connected with both of the slide and the connection piece.

BRIEF OF THE DRAWINGS

DETAILED DESCRIPTION OF A PREFERRED EMBODIMENT

Figure 1:
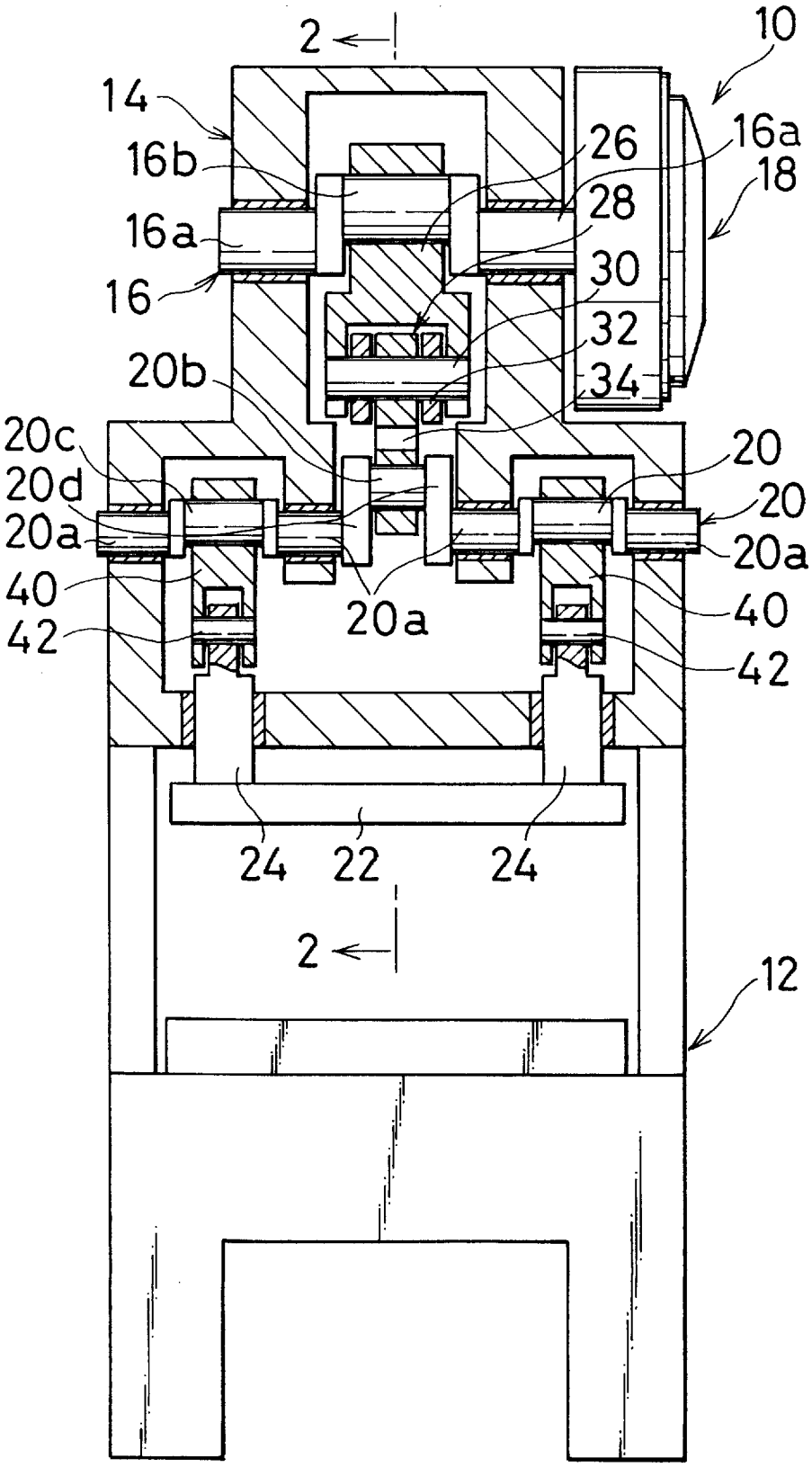
FIG. 1 is an elevational view, partly in section, of a press machine according to an embodiment of the invention.
Figure 2:
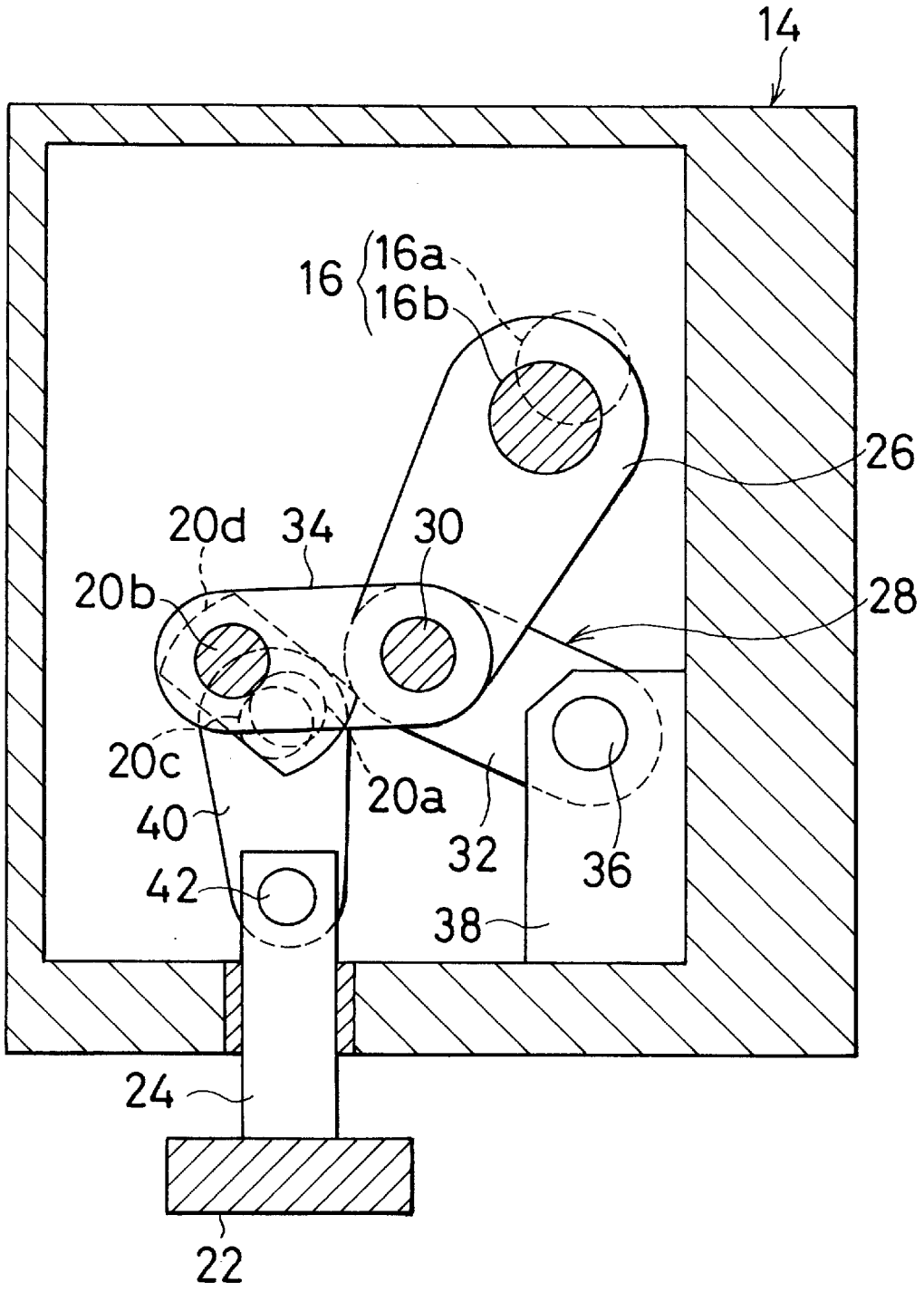
FIG. 2 is a sectional view taken substantially on line 2—2 of FIG. 1, wherein a frame portion is omitted in part.

Referring now to FIGS. 1 and 2, a press machine 10 includes a lower frame 12 on which a lower half die is to be mounted, and an upper frame 14 arranged on the lower frame 12 to be supported thereby.

The first crankshaft 16 is supported by the upper frame 14 such that it can rotate about an axis horizontally extending through the upper frame 14. The first crankshaft 16 also supports at its one end a fly wheel 18 which is provided with a mechanism of deceleration. The first crankshaft 16 also includes a pair of principal shaft portions 16*a* and an eccentric shaft portion 16*b* formed to intervene between both of principal shaft portions 16*a*.

The second crankshaft 20 is arranged on the lower side of the first crankshaft 16 so as to take such a position that the first crankshaft 16 obliquely looks it downward. The second crankshafts 20 is also supported by the upper frame 14 such that they are allowed to rotate about an axis horizontally extending through the upper frame 14. The second crankshaft 20 includes a plurality of principal shaft portions 20*a* supported by the upper frame 14, a first eccentric shaft portion 20*b* located at center thereof, two second eccentric shaft potions 20*c*, and two arm portions 20*d* which connect the first eccentric shaft portion 20*b* with the principal shaft portions 20*a*, respectively.

The second crankshaft 20 may be divided into two crankshaft units, of which each includes two principal shaft portions 20*a*, a second eccentric shaft portion 20*c* formed between both principal shaft portions 20*a*, and an arm portion 20*d*. Thus, the second crankshaft 20 can be fabricated by pivotally and eccentrically connecting two crankshaft units to the other end of a lever 34 through the arm portion 20*d*.

A slide 22 to which an upper die is to be fitted, is arranged on the lower ends of a pair of rods 24 which can move in the up and down directions, penetrating through the lower end portion of the upper frame 14.

The eccentric shaft portion 16*b* of the first crankshaft 16 and the first eccentric shaft portion 20*b* of the second crankshaft 20 are connected with each other by means of a link 26 and a connection mechanism 28. The connection mechanism 28 is provided with a pair of levers 32 and 34, of which respective one ends are connected with each other through a shaft or a pivot 30 such that they can bend and stretch about the pivot 30. The pivot 30 also connects the link 26 with both of levers 32 and 34.

The other end of lever 32 is pivotally connected with the frame 14 through a pivot 36 formed on the bracket 38. The other end of the lever 34 is pivotally connected with the first eccentric shaft portion 20*b* of the second crankshaft 20. Consequently, levers 32 and 34 can be bent in the form of a mountain having its peak at the pivot 30.

A connection piece 40 which functions as a connection body is pivotally connected, through its one end, with each of the second eccentric shaft portions 20*c*. The other end of the connection piece 40 is pivotally connected with the upper end of the rod 24 through a pivot 42.

The first and second crankshafts 16 and 20, and the pivots 30, 36, and 42 are arranged to extend in parallel, so that the principal shaft portions 16*a* and 20*a*, and eccentric shaft portions 16*b*, 20*b*, and 20*c* are made respectively parallel. The second crankshaft 20 is arranged so as to rotate or rock about its rotary axis line but not to move in any up-and-down, back-and-forth, and left-and-right direction.

Therefore, as the first crankshaft 16 is rotated, the lever 32 comes to initiate its rocking motion or swing motion about the shaft 36, which in turn causes the bending-stretching motion by both of levers 32 and 34. With this motion, the second crankshaft 20 begins its rocking motion or swing motion about its rotary axis, 80 that the connection body 40 comes to move in the up and down directions, turning about the pivot 42. As a result, the rods 24 and the slide 22 come to move together in the up and down directions.

As has been discussed above, as the press machine 10 according to the invention is provided with the second crankshaft 20, the rotary motion of the first crankshaft 16 is once converted into the rocking motion of the second crankshaft 20 with the help of the link 26 and both of levers 32 and 34, and is then transmitted to the slider 22. Thus, there can be a remarkable reduction in the number of parts constituting the transmission mechanism for transmitting the rotational motion of the first crankshaft rotated by the driving source to the slide 22. As a result, not only the structure of the transmission mechanism can be simplified but also its force of inertia can be made smaller, thus enabling the press machine to operate at high speed.

In the embodiment as described above, the link 26 is connected with the joint portion between levers 32 and 34. However, this is not always needed. The link 26 may be pivotally connected with either the lever 32 or 34.

The invention is not limited to the embodiments as described above. For instance, the invention is applicable to a press machine which is provided with a balancing weight. Therefore, it will be apparent to those skilled in the art that changes and modifications can be made without departing from the principle and spit of the invention and the scope defined by the appended claims.

What is claimed is:

1. A press machine comprising a frame, a first crankshaft rotatively arranged on said frame and having an eccentric shaft a second crankshaft arranged on said frame so as to rotate angularly about a first pivot, a pair of levers connected with each other about a second pivot such that they can make a bending and stretching motion, one lever being connected with said frame so as to make a pivotal motion, while the other lever being pivotally connected with an eccentric shaft portion of said second crankshaft, so that the bending and stretching motion of the pair of levers causes said second crankshaft to perform a rocking motion, a link which connects said levers with said first crankshaft in a manner such that the levers bend and stretch as a result of rotation of said first crankshaft, and a slide connected with said second crankshaft so as to move upwardly and downwardly with the rocking motion of said second crankshaft.

2. A press machine as claimed in claim 1, wherein said second crankshaft further includes a second eccentric shaft portion connecting said second crankshaft with said slide.

3. A press machine as claimed in claim 2 further comprising a connection piece connected between the second eccentric shaft portion of said second crankshaft for moving said slide upwardly and downwardly with rocking motion of said second crankshaft.

4. A press machine as claimed in claim 3 further comprising rods arranged on said frame so as to move upwardly and downwardly, the rods being connected to the slide and pivotally connected with said connection piece.

5. A press machine as claimed in claim 1, wherein said link is connected with both of said levers so as to make pivotal motion about said second pivot.

* * * * *